US006992634B2

(12) United States Patent
Hashidate et al.

(10) Patent No.: US 6,992,634 B2
(45) Date of Patent: Jan. 31, 2006

(54) ANTENNA DEVICE COMMONLY USED FOR TWO FREQUENCIES

(75) Inventors: Takeshi Hashidate, Tokyo (JP); Iichi Wako, Tokyo (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 0 days.

(21) Appl. No.: 10/900,336

(22) Filed: Jul. 28, 2004

(65) Prior Publication Data

US 2005/0104789 A1 May 19, 2005

(30) Foreign Application Priority Data

Jul. 29, 2003 (JP) ..... P2003-281804

(51) Int. Cl.
*H01Q 3/38* (2006.01)
*H01Q 21/00* (2006.01)

(52) U.S. Cl. ..... 343/700 MS; 343/725; 343/728; 343/846

(58) Field of Classification Search ..... 343/700 MS, 343/728
See application file for complete search history.

(56) References Cited

U.S. PATENT DOCUMENTS 5,300,936 A * 4/1994 Izadian ..... 343/700 MS
5,952,971 A * 9/1999 Strickland ..... 343/700 MS
2004/0051675 A1 * 3/2004 Inoue ..... 343/728
2004/0217907 A1 * 11/2004 Inoue ..... 343/728

FOREIGN PATENT DOCUMENTS

JP 9-98014 A 4/1997

* cited by examiner

*Primary Examiner*—Trinh Vo Dinh
(74) *Attorney, Agent, or Firm*—Sughrue Mion, PLLC

(57) ABSTRACT

A patch antenna for a first frequency is disposed on a first face of a dielectric substrate, and has a first size. A coil antenna for a second frequency is disposed on the first face of the dielectric substrate so as to surround the patch antenna, and has a second size which is larger than the first size. A ground member is disposed on a second face of the dielectric substrate, and has a third size which is larger than the first size and smaller than the second size.

2 Claims, 2 Drawing Sheets

ANTENNA DEVICE COMMONLY USED FOR TWO FREQUENCIES

BACKGROUND OF THE INVENTION

The present invention relates to an antenna device commonly used for two frequencies in short distance communication.

Conventionally, a wireless tag reader system has been put into practical use in which a wireless ID tag (responder) is attached to a commercial product, an article, or the like, and a unique identification data that is previously set in the wireless ID tag is wirelessly read by an ID reader. Also another system such as an automatic ticket gate system has been put into practical use in which a data stored in an IC card or the like in place of such an ID tag is wirelessly read by a reader.

FIG. 3 shows an example of a general configuration of a wireless tag system. An ID reader 10 comprises a transmitter 11 and a receiver/demodulator 12. The transmitter 11 amplitude-modulates a transmission carrier wave with an inquiry signal and a clock signal, and outputs the modulated signal. The transmission signal output from the transmitter 11 is supplied to an antenna 15 via a directional coupler 13 and a circulator 14, and then transmitted from the antenna 15 to a wireless ID tag 20. For example, a loop antenna is used as the antenna 15 of the ID reader 10 (for example, see Japanese Patent Publication No. 9-98014A). A part of the output signal of the transmitter 11 is supplied to the receiver/demodulator 12 via the directional coupler 13.

Generally, the wireless ID tag 20 is configured with using an IC chip in the following manner. A radio wave transmitted from the antenna 15 of the ID reader 10 is received by a tag antenna 21. A driving power is generated from the received radio wave to operate an internal logic circuit. The unique identification data which is previously stored in a memory is read out, and the transmission carrier wave transmitted from the ID reader 10 is amplitude-modulated therewith. The modulated carrier wave is reradiated to the ID reader 10 as a return wave.

The ID reader 10 receives at the antenna 15 the return wave from the wireless ID tag 20, and supplies the received wave to the receiver/demodulator 12 via the circulator 14. The receiver/demodulator 12 extracts the clock signal from the output signal of the transmitter 11 which is supplied via the directional coupler 13, demodulates the identification data of the wireless ID tag 20, converts the demodulated data into a digital data, and sends the digital data to a host apparatus such as a personal computer (not shown).

In this way, the ID reader 10 can read the identification data of the wireless ID tag 20, and check the contents of the data.

In FIG. 3, the example in which the identification data of the wireless ID tag 20 is checked by the ID reader 10 is shown. Recently, also a system in which the single ID reader 10 can check not only the identification data of the wireless ID tag 20, but also that of another medium such as an IC card has been proposed. In this case, for example, a frequency of 2.4 GHz is used for identifying the data of the wireless ID tag 20, and that of 13.56 MHz is used for identifying the data of the IC card. Therefore, antennas respectively for 2.4 GHz and 13.56 MHz must be prepared as the antenna 15 of the ID reader 10.

In the case where the ID reader 10 identifies not only the data of the wireless ID tag 20, but also that of another medium using a different frequency as described above, it is required to use two antennas respectively corresponding to the use frequencies. This impedes reduction of the size of an apparatus. Recently, it has been attempted to provide a personal digital assistant with the function of the ID reader 10, and an antenna is requested to reduce its size.

SUMMARY OF THE INVENTION

It is therefore an object of the invention to provide a two-frequency antenna device in which two antenna elements are mounted on a single antenna substrate so as to respectively cope with different frequencies, and desired characteristics can be obtained while reducing the size.

In order to achieve the object, according to the invention, there is provided an antenna device comprising:

a dielectric substrate;

a patch antenna for a first frequency, disposed on a first face of the dielectric substrate, and having a first size;

a coil antenna for a second frequency, disposed on the first face of the dielectric substrate so as to surround the patch antenna, and having a second size which is larger than the first size; and a ground member, disposed on a second face of the dielectric substrate, and having a third size which is larger than the first size and smaller than the second size.

Preferably, a minimum distance between an outer edge of the patch antenna and an outer edge of the ground member, and a minimum distance between an inner edge of the coil antenna and the outer edge of the ground member are two or more times a thickness of the dielectric substrate.

Since the patch antenna and the coil antenna are combinedly formed on the dielectric substrate, the antenna device can cope with two frequencies, while the area on the dielectric substrate can be effectively used, so that the size can be reduced. When the minimum distances between the ground plane for the patch antenna, and the patch antenna and the coil antenna are adequately selected, moreover, the antenna characteristics are compatible with each other.

DETAILED DESCRIPTION OF THE INVENTION

Hereinafter, one embodiment of the invention will be described with reference to the accompanying drawings.

Figure 1:
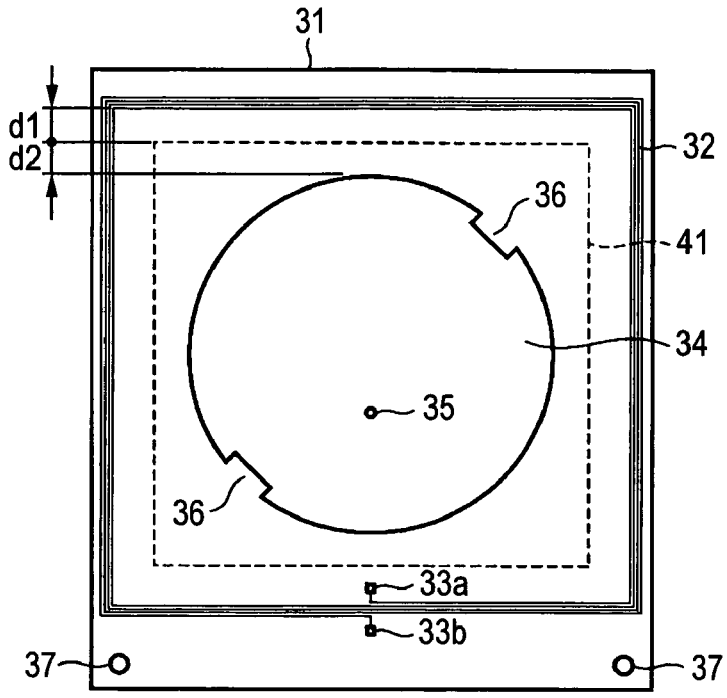
FIG. 1 is a front view of a two-frequency antenna device according to one embodiment of the invention.
Figure 2:
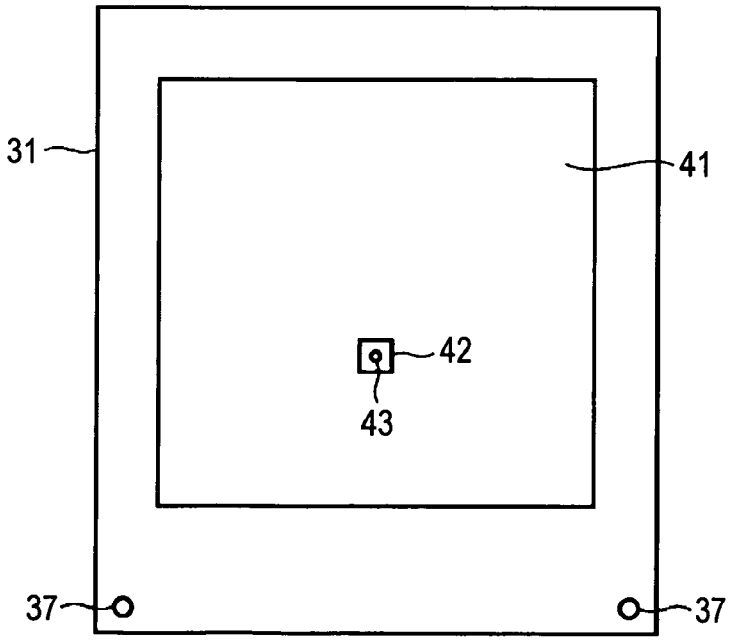
FIG. 2 is a rear view of the antenna device of FIG. 1.
Figure 3:
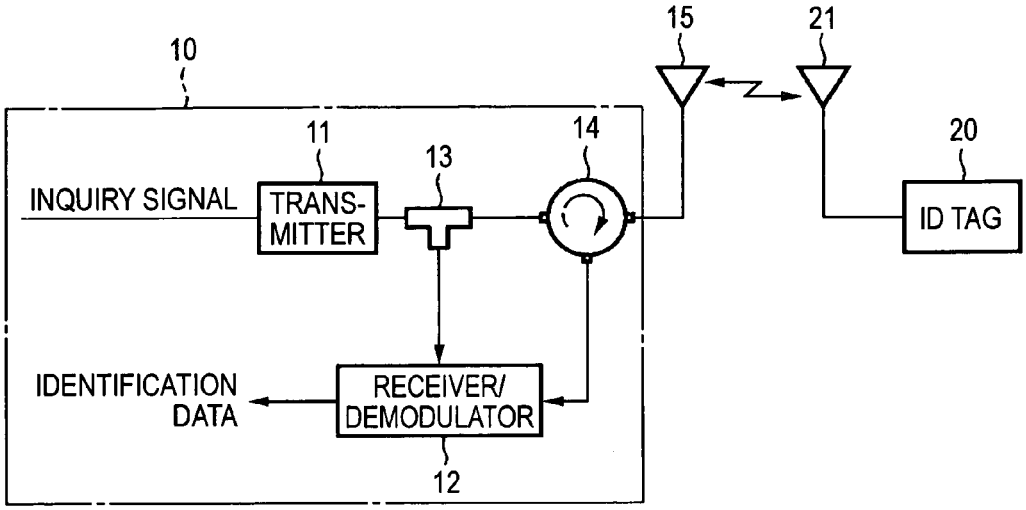
FIG. 3 is a diagram showing an example of a general configuration of a wireless tag reader system.

FIG. 1 is a front view of a two-frequency antenna device of the invention, and FIG. 2 is a rear view of the device. In FIGS. 1 and 2, 31 denotes an antenna substrate, i.e., a dielectric substrate which is formed into a rectangular shape having, for example, a thickness of about 1.6 mm, a short side of about 65 mm, and a long side of about 75 mm. On the upper face of the dielectric substrate 31, a rectangular coil antenna 32 is formed by a process such as etching so as to elongate along the periphery, and a circularly polarized radiating element such as a circular patch antenna 34 is formed in a center portion.

The coil antenna 32 is an antenna for a first frequency, for example, 13.56 MHz, and formed by about four turns of a microstrip line. The end portions of the antenna are connected to feeding terminals 33*a*, 33*b*, respectively. The feeding terminals 33*a*, 33*b* are disposed, for example, in a lower center portion of the coil antenna 32.

The patch antenna 34 is an antenna for a second frequency, for example, 2.4 GHz. A feeding point 35 is disposed in the vicinity of a center portion, and a pair of notches 36 for a circularly polarized wave are disposed in the outer peripheral edge. The diameter of the patch antenna 34 is set to about λg/2 where λg is a wavelength corresponding to the communication frequency. In the value of the wavelength, the wavelength reduction factor of the dielectric substrate 31 is considered.

The dielectric substrate 31 is formed into a vertically elongated rectangular shape, so that a lower side portion is configured as a mounting portion which is to be attached to another apparatus. Mounting holes 37 are opened in right and left corners of the mounting portion, respectively.

A ground plane 41 has, for example, a rectangular shape so as to correspond to the patch antenna 34 is formed on the rear face of the dielectric substrate 31 by a process such as etching. The size of the ground plane 41 is smaller than that of the coil antenna 32, and larger than that of the patch antenna 34. For example, both the minimum distance d1 between the coil antenna 32 and the outer periphery of the ground plane 41, and the minimum distance d2 between the patch antenna 34 and the outer periphery of the ground plane 41 are set to be at least two or more times the thickness of the dielectric substrate 31.

In the ground plane 41, a window 42 which is larger than the feeding point 35 of the patch antenna 34 is formed in a position corresponding to the feeding point 35, and a feeding portion 43 is formed at the center of the window. The feeding point 35 and the feeding portion 43 are electrically connected to each other via, for example, a through hole. A feeding connector is disposed in the feeding portion 43 as required.

In the coil antenna 32, an opposite magnetic field is generated by an eddy current on the ground plane 41. Therefore, the minimum distance d1 between the inner edge of the coil antenna 32 and the outer edge of the ground plane 41 is preferably set to be at least two or more times the thickness of the dielectric substrate 31. In the embodiment, the distance from the coil antenna 32 to the ground plane 41 is set to about 4 mm, whereby the characteristics of the coil antenna 32 is able to be satisfactorily maintained.

By contrast, as the size of the ground plane 41 is larger, the patch antenna 34 exhibits more excellent characteristics. Therefore, the minimum distance d2 between the outer edge of the patch antenna 34 and the outer edge of the ground plane 41 is preferably set to be at least two or more times the thickness of the dielectric substrate 31. In the embodiment, the width of the ground plane 41 is formed so as to be larger by 4 mm or more than the diameter of the patch antenna 34, whereby the characteristics of the patch antenna 34 is able to be maintained.

Since the coil antenna 32 and the patch antenna 34 are formed on the single dielectric substrate 31 as described above, the antenna device can cope with the two frequencies of 13.56 MHz and 2.45 GHz. Since the coil antenna 32 and the patch antenna 34 are formed together, the area of the dielectric substrate 31 can be effectively used, so that the size can be reduced. Since the minimum distances d1, d2 between the ground plane 41, and the coil antenna 32 and the patch antenna 34 are adequately selected, moreover, the antenna characteristics are compatible with each other.

When the antenna device is used as an antenna of an ID reader, not only the antenna device can cope with plural kinds of apparatuses of different use frequencies, such as a wireless ID tag, an IC card, and an ID card, but also the size of the ID reader can be reduced. The antenna device can be used not only in an ID reader, but also in, for example, a portable information terminal such as a personal digital assistant. Therefore, the apparatus can be used for various purposes.

In the embodiment, the case where the antenna device copes with the frequencies of 13.56 MHz and 2.45 GHz has been described. It is a matter of course that the antenna device may be used for other frequencies.

In the embodiment, the case where the circular patch antenna 34 is used has been described. It is possible to attain the same effects also in another case such as that in which a rectangular patch antenna, an annular patch antenna, or the like is used.

In the embodiment, the case where the coil antenna 32 and the ground plane 41 are formed into a rectangular shape has been described. Alternatively, they may be formed into a circular shape. Also the dielectric substrate 31 is not restricted to a rectangular shape, and may be formed into a circular shape or another shape.

The invention is not restricted to the embodiment described above. In a practical stage, the invention can be embodied while modifying the components without departing from the spirit of the invention.

What is claimed is:

1. An antenna device comprising:

a dielectric substrate;

a patch antenna for a first frequency, disposed on a first face of the dielectric substrate, and having a first size;

a coil antenna for a second frequency, disposed on the first face of the dielectric substrate so as to surround the patch antenna, and having a second size which is larger than the first size; and a ground member, disposed on a second face of the dielectric substrate, and having a third size which is larger than the first size and smaller than the second size.

2. The antenna device as set forth in claim 1, wherein a minimum distance between an outer edge of the patch antenna and an outer edge of the ground member, and a minimum distance between an inner edge of the coil antenna and the outer edge of the ground member are two or more times a thickness of the dielectric substrate.

* * * * *